US010626506B2

(12) United States Patent
Morris et al.

(10) Patent No.: US 10,626,506 B2
(45) Date of Patent: Apr. 21, 2020

(54) ANODE SLURRY FOR CATHODIC PROTECTION OF UNDERGROUND METALLIC STRUCTURES AND METHOD OF APPLICATION THEREOF

(71) Applicant: YPF Technologia S. A., Buenos Aires (AR)

(72) Inventors: Walter Morris, Buenos Aires (AR); Angel Vico, Buenos Aires (AR)

(73) Assignee: YPF TECNOLOGIA S.A., Ciudad Autonoma de Buenos Aires (AR)

( * ) Notice: Subject to any disclaimer, the term of this patent is extended or adjusted under 35 U.S.C. 154(b) by 180 days.

(21) Appl. No.: 15/388,869

(22) Filed: Dec. 22, 2016

(65) Prior Publication Data

US 2017/0183784 A1 Jun. 29, 2017

Related U.S. Application Data

(60) Provisional application No. 62/387,175, filed on Dec. 23, 2015.

(51) Int. Cl.

| | |
|---|---|
| ***C23F 13/02*** | (2006.01) |
| ***C23F 13/14*** | (2006.01) |
| ***E21B 41/02*** | (2006.01) |
| ***C23F 13/18*** | (2006.01) |
| ***C23F 13/10*** | (2006.01) |

(52) U.S. Cl.

CPC ..... *C23F 13/14* (2013.01); *C23F 13/10* (2013.01); *C23F 13/18* (2013.01); *E21B 41/02* (2013.01); *C23F 2213/32* (2013.01)

(58) Field of Classification Search

CPC ..... C23F 13/02; C23F 13/06; C23F 13/08; C23F 13/10; C23F 13/12–13/14; C23F 13/16; C23F 2213/30; C23F 2213/31; C23F 2213/32; E21B 41/02

See application file for complete search history.

(56) References Cited

U.S. PATENT DOCUMENTS

| | | | | |
|---|---|---|---|---|
| 3,354,063 A * | 11/1967 | Shutt | F16L 58/00 204/196.3 |
| 5,139,634 A * | 8/1992 | Carpenter | C23F 13/04 204/196.03 |
| 2013/0081955 A1* | 4/2013 | Al-Mubasher | C23F 13/16 205/724 |

(Continued)

FOREIGN PATENT DOCUMENTS

| | | | |
|---|---|---|---|
| EP | 0443229 A1 * | 8/1991 | C08K 3/22 |

OTHER PUBLICATIONS

L.L. Shreir et al. , "Corrosion", Corrosion Control , 1994, vol. 2, Chap. 10, Butterworth Heinemann, pp. 10-3 to 10-170.

*Primary Examiner* — Alexander W Keeling

(74) *Attorney, Agent, or Firm* — Muncy, Geissler, Olds & Lowe, PC

(57) ABSTRACT

An anode slurry for cathodic protection to underground metallic structures, preferably for casings of hydrocarbon producing wells or water injecting/producing wells, comprising a granulated electrical conducting material as anode and optionally a granulated filler with high electrical conductivity (backfill). There is also disclosed a method for providing cathodic protection to underground metallic structures by injecting an anode slurry into the underground formation containing the metallic structures.

6 Claims, 6 Drawing Sheets

(56) References Cited

U.S. PATENT DOCUMENTS

| | | | | |
|---|---|---|---|---|
| 2014/0084221 | A1* | 3/2014 | Matzdorf | C09D 5/084<br>252/512 |
| 2015/0053573 | A1* | 2/2015 | Kia | C23F 13/12<br>205/732 |

* cited by examiner

ANODE SLURRY FOR CATHODIC PROTECTION OF UNDERGROUND METALLIC STRUCTURES AND METHOD OF APPLICATION THEREOF

FIELD OF THE INVENTION

The invention refers to an anode composition for providing cathodic protection to underground metallic structures. The composition comprises a slurry comprising a fluid carrier containing a granulated electrical conducting material.

BACKGROUND OF THE INVENTION

Cathodic protection is one of the methods used to reduce corrosion problems in metallic structures exposed to aggressive aqueous environments. It is one of the most effective techniques for corrosion control, applied in a number of industrial fields. The application thereof was first reported by Humphrey Davy in 1824, disclosing a sacrificial system for protecting copper components employed in ship hulls comprising zinc or iron plates.

On one hand, cathodic protection systems with sacrificial anodes employ metals with electronegative electrochemical potential, like zinc, aluminum, magnesium or alloys thereof to protect more noble or electropositive metals and alloys, like iron, steel, copper, titanium, etc. The potential difference between the anodic metal and the structure to be protected (i.e. cathode) provides the driving force that creates a charge flow or protection current.

A cathodic protection system with sacrificial anode comprises four main components: an anode (a metal or alloy with electronegative potential), a cathode (a structure to be protected which has a more electropositive potential than that of the anode), an electrical contact between the anode and the cathode and an electrolyte (or corrosive medium) in which the anode and the cathode are immersed.

On the other hand, impressed current cathodic protection systems employ an external source of electric power to generate a potential difference between anode and cathode that enables to provide a protection current. In this case, a metal or conductive material with high corrosion resistance, like silicon-iron alloys, graphite, MMO (Mixed Metal Oxides), and stainless steel, is used as an impressed current anode, so as to ensure proper protection system durability. FIG. 4 shows an impressed current cathodic protection system scheme.

Therefore, to provide cathodic protection to a structure it is necessary to install a predetermined anodic metal mass close to the cathode (i.e. structure) to be protected. The electrochemical potential difference between the anode and the cathode will provide a system protection current. This current will depend not only on the electric potential difference between the anode and the cathode but also on the electric/electrolytic resistance of the circuit, according to Ohm's Law.

$$I=(Ea-Ec)/R \quad [1]$$

In turn, resistance R depends on the electric resistivity of the medium and on the geometry and proximity of the anode to the structure to be protected. The higher the value of R, the lower the current provided by the protection system. Accordingly, in order to achieve proper protection for the metallic structure, the sacrificial anodes should be located so as to obtain a protection current distribution as homogeneous as possible. In this regard, for cathodic protection of oil producing wells or water injectors/producers it is complicated to achieve a uniform current distribution along the casing length. Although for this kind of structures impressed current cathodic protection systems are usually employed, enabling to produce larges currents, the high variation of formation electric resistivity across the well often causes that the protection current cannot reach the deep casing areas exposed to corrosive formations and aquifers. FIG. 5 shows an impressed current cathodic protection installation of a hydrocarbon producing well having a heterogeneous current distribution due to the variation of formation electric resistivity.

The current distribution problems shown in FIG. 5 also occur in other type of installations like pipelines, tanks batteries and industrial facilities. Besides high initial costs, maintenance problems and vandalism, impressed current cathodic protection systems applied to hydrocarbon producing wells or water injectors/producers often create interference problems with neighboring metallic structures.

The present invention provides an impressed current anode system that provides a solution of these kinds of technical problems, as it is disclosed below.

BRIEF DESCRIPTION OF THE INVENTION

In a first aspect, the present invention provides a cathodic protection composition applicable to underground metallic structures, preferably for casings of hydrocarbon producing wells or water injecting/producing wells. The composition acts as a liquid anode, in the form of a slurry comprising a granulated conducting material and a carrier fluid. The slurry may further comprise a filler material with high electric conductivity, hereinafter referred to as "backfill", as well as viscosifiers and other additives commonly used in well completion fluids.

The granulated electrical conducting material may be selected according to the kind of protection system to be applied to, i.e. sacrificial anode or impress current system. The carrier fluid comprised in the slurry has an adequate viscosity so as to carry all particulate solid materials.

In a second aspect, the present invention provides a method for cathodically protecting underground metallic structures, preferably for casings of hydrocarbon producing wells and water injectors/producers that employs a liquid anode composition in the form of a slurry that can be pumped into the well down into the underground formation and located to a specific depth where protection is needed.

Therefore, it is an object of the present invention, an anode slurry composition comprising a solid material in a carrier fluid, usable in cathodic protection systems for underground metallic structures, comprising a granulated electrical conducting material as anode.

In a preferred embodiment of the present invention, the anode slurry composition further comprises a granulated high electrical conductivity backfill.

In another preferred embodiment of the present invention, the concentration of the granulated electrical conducting material in the slurry is in the range of 10-100% based on the total weight of solid material.

In another preferred embodiment of the present invention, the concentration of the granulated high electrical conductivity backfill is up to 90% based on the total weight of solid material.

In a preferred embodiment of the present invention, the granulated electrical conducting material is a granulated metallic electrical conducting material.

In a more preferred embodiment of the present invention, for application to a cathodic protection system with sacrificial anode, the granulated metallic electrical conducting material is a metal selected from the group comprising Al, Zn, Mg and alloys and mixtures thereof.

In yet another preferred embodiment of the present invention, for application to an impressed current cathodic protection system, the granulated metallic electrical conducting material is a metal showing high corrosion resistance, selected from the group comprising silicon-iron alloys, stainless steel, titanium, platinum and combinations thereof.

In yet another preferred embodiment of the present invention, the granulated electrical conducting material is a granulated non-metallic electrical conducting material.

In a preferred embodiment of the present invention, for application to an impressed current cathodic protection system, the granulated non-metallic electrical conducting material consists of a non-metallic material, selected from the group comprising graphite, Mixed Metal Oxides (MMO) and combinations thereof.

In an embodiment of the present invention, the granulated high electrical conductivity backfill is selected from the group comprising coke, activated carbon or coke, graphite and combinations thereof.

In another embodiment of the present invention, the concentration of the granulated high electrical conductivity material (backfill) is up to 90% based on the total weight of solid material.

In another preferred embodiment of the present invention, the anode slurry further comprises viscosifier agents and other additives commonly used in well completion fluids.

It is also an object of the present invention a method for providing cathodic protection to an underground metallic structure comprising the injection and pumping of an anode slurry consisting of a solid material in a carrier fluid, comprising at least one granulated electrical conducting material as anode into an underground formation containing said metallic structure.

In an embodiment of the method of the present invention, the metallic structure is part of a hydrocarbon producing well or a water injecting/producing well.

In a preferred embodiment of the method of the present invention, the metallic structure is a casing.

In a more preferred embodiment of the method of the present invention, when applied to sacrificial protection of hydrocarbon producing wells or water injector/producing wells, the slurry is injected into the formation through punched holes made in the casing.

In a yet preferred embodiment of the method of the present invention, the injection and pumping is performed at a hydraulic fracture regime or rate so as to ensure packing and electric contact between the solid material contained in the slurry and the structure to be protected.

In a most preferred embodiment of the method of the present invention, the injection and pumping is performed at a pressure higher than the fracture gradient of the underground formation containing the metallic structure.

DETAILED DESCRIPTION OF THE INVENTION

The present invention provides an anodic liquid composition in form of a slurry comprising at least a carrier fluid and a granulated electrical conducting material.

For the purpose of the following detailed description, the anode slurry composition of the invention may be also referred to simply as "slurry" and the granulated electrical conducting material may be also referred to as a "granulated anode material" or "anode".

The slurry of the invention may further comprise high electric conductivity backfill, also referred to herein as "backfill", preferably graphite or activated carbon or coke and viscosifiers to improve viscosity and thus the carrying ability of the solid materials contained in the slurry.

The slurry of the present invention has suitable fluidity and viscosity so as to be pumped into a subterranean formation allowing the transport of all solid materials (e.g. granulated anode material and backfill) that provide anti-corrosion protection to a metallic structure, especially hydrocarbon producing wells or water injecting/producing wells.

In the case of sacrificial cathodic protection systems, the granulated anode material contained in the slurry preferably is a metal selected from the group comprising zinc, aluminum, magnesium and alloys thereof.

In the case of impressed current cathodic protection systems, the granulated anode material consists of corrosion resistant materials, metallic or non-metallic, like iron-silicon alloys, stainless steel, graphite and/or MMO.

Figure 1:
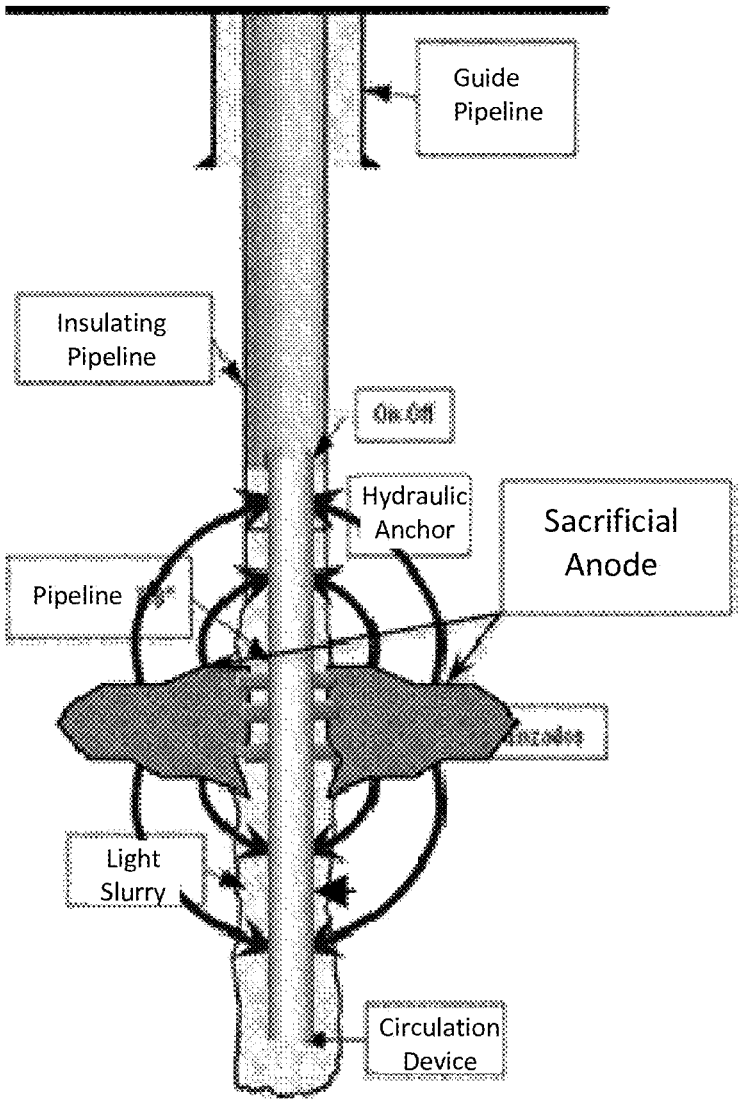
FIG. 1 shows an embodiment of the present invention, illustrating a schematic view of a composition of the invention applied as a liquid sacrificial anode to the protection of casings in hydrocarbon producing wells or water injecting/producing wells.

When applied to sacrificial cathodic protection systems in hydrocarbon producing wells or water injecting/producing wells, the anode slurry composition of the invention is injected into the formation through perforations made in the casing, as shown in FIG. 1.

Figure 2:
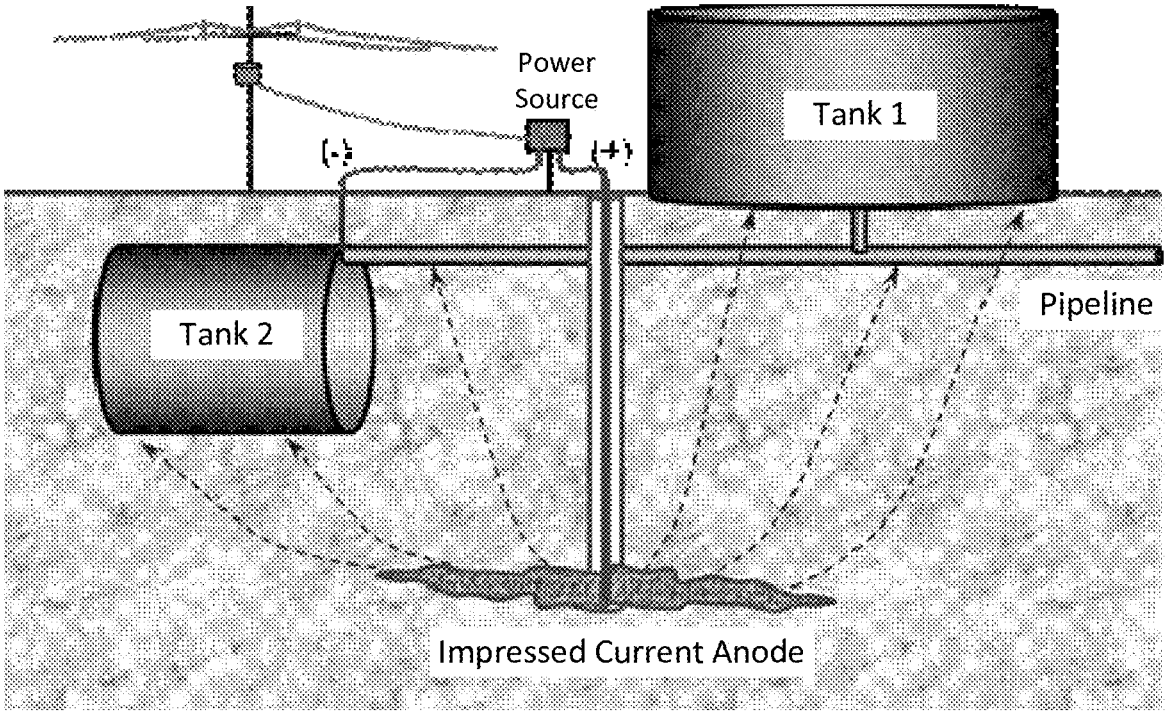
FIG. 2 shows another embodiment of the present invention, illustrating a schematic view of an impressed current cathodic protection system with a composition of the invention applied as an impressed current anode.
Figure 3:
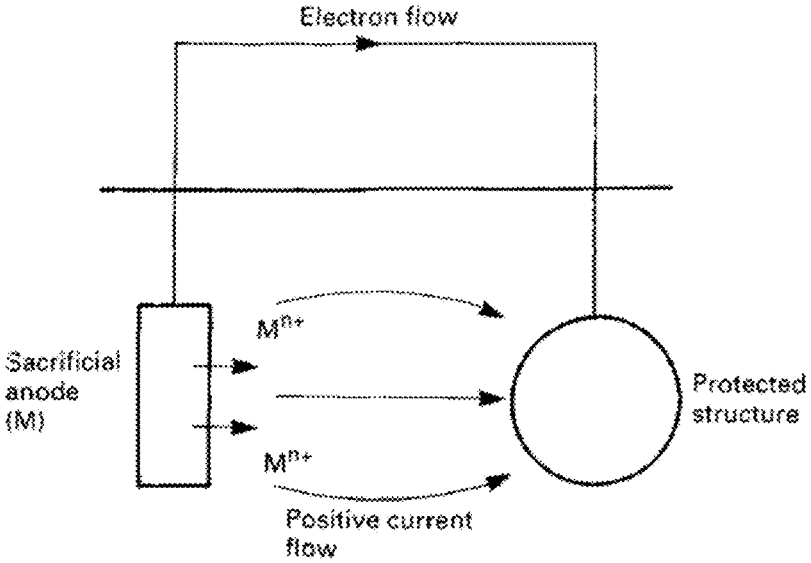
FIG. 3 shows a prior art basic installation scheme of a cathodic protection system with sacrificial anode.
Figure 4:
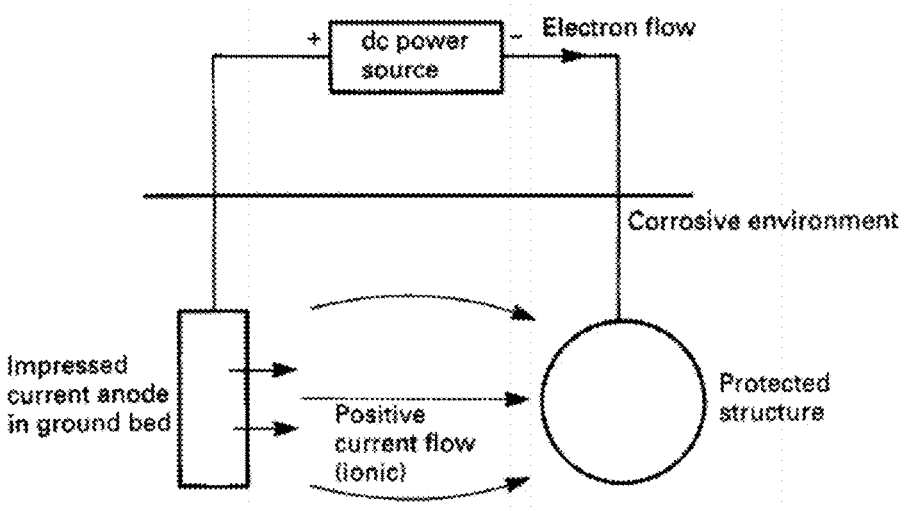
FIG. 4 shows a prior art impressed current cathodic protection system scheme.
Figure 5:
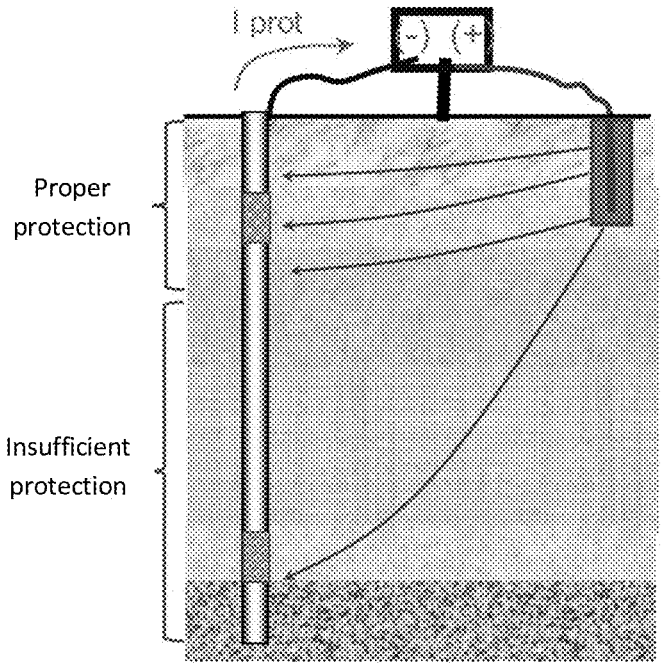
FIG. 5 shows a prior art impressed current cathodic protection installation in a hydrocarbon producing well having a heterogeneous current distribution due to the variation of electric resistivity of formations crossed by the well.

When applied to impressed current cathodic protection systems, the anode slurry composition of the invention is pumped by means of an ad hoc installation reaching the formation into which the granulated anodic metal is being located, as shown in FIG. 2.

Figure 6:
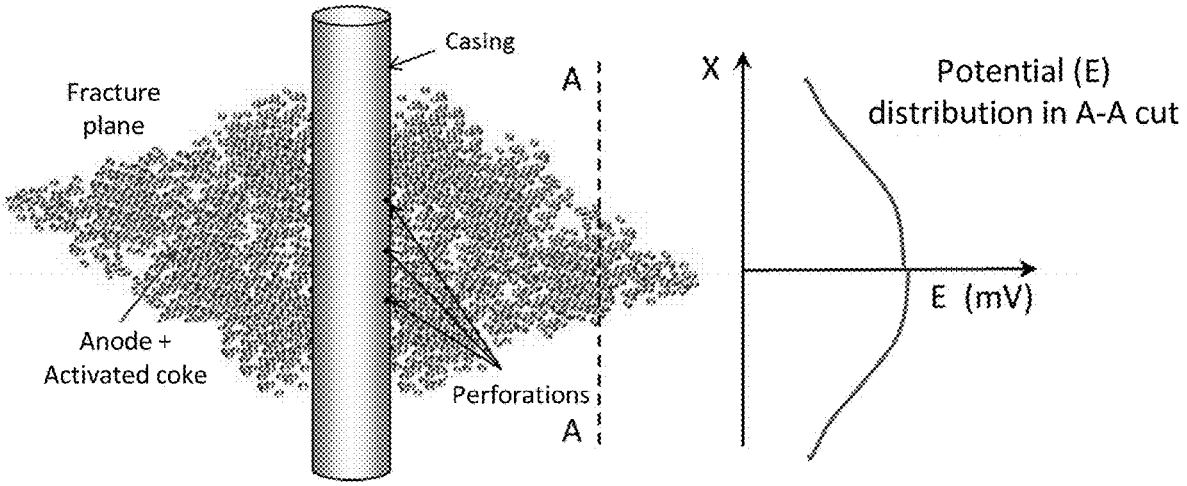
FIG. 6 shows a schematic view of an anodic pack location in the vicinity of a casing to be protected, obtained with the composition and method of the present invention.

In both cases above, pumping is performed at a hydraulic fracture regime or rate so as to achieve a suitable anode geometry and electric contact between the solid material contained in the slurry and the metallic structure to be protected. The pumping operation may be performed as batch-frac, to which end the slurry is prepared in a mixer and then pumped into the well at a hydraulic fracture regime or rate by means of at least one high pressure pump. The pressure and pumping regime or rate will depend on slurry rheological properties, pipe diameter, type and number of punched holes and formation fracture gradient. FIG. 1 shows a schematic view of a sacrificial anode pack geometry once it is pumped into the well. FIG. 6 shows a schematic view of the anode pack location in the vicinity of the casing to be protected.

Figure 7:
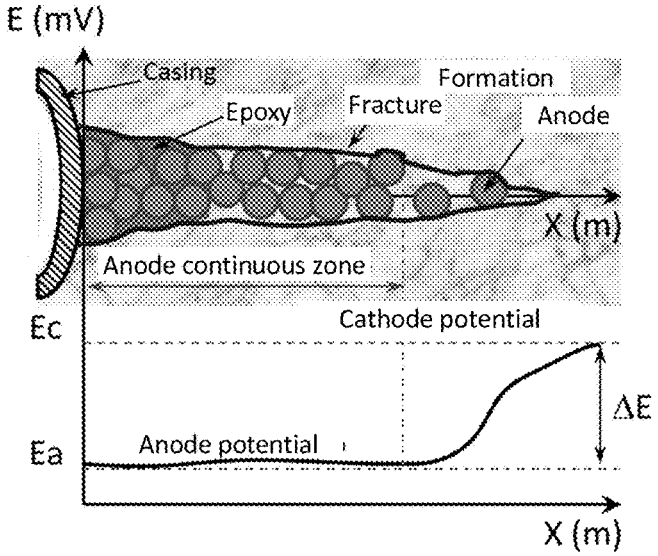
FIG. 7 shows a schematic view of the way electric contact is produced between an anodic metal in the composition of the invention and a casing to be protected.

Electrical continuity between the anode particles, the high conductivity backfill and a casing or disperser, depending on the system applied (sacrificial system or impressed current system), is achieved by the closure stress of the produced fracture. FIG. 7 shows a schematic view of electrical continuity between said materials once pumped into the well. As illustrated therein, the electrochemical potential distribution is kept constant within the anode pack since the metal particles are in electric contact between each other. The potential variation is produced on the interface between the anode pack and the underground formation. On said interface an anodic reaction is produced and it provides electric charges, and therefore, the protection current that cathodically polarizes the structure.

In the case of sacrificial systems, the anodic reaction corresponds to the dissolution of the metal that acts as sacrificial anode ($Me_A$) according to the following reaction:

$$Me_A \rightarrow Me_A^{2+} + 2e^- \quad [2]$$

This way, the anode dissolution will always occur on the anode-formation interface, causing a gradual consumption of the anode pack over time. This phenomenon is experimentally verified according to the Examples below.

In the case of a slurry of the invention used for impressed current disperser anodes, with a granulated metal with high corrosion resistance, the anodic reaction is:

$$\text{Aqueous media: } 2H_2O \rightarrow 2O_2O_2 + 4H^+ + 4e^- \quad [3], \text{ or}$$

$$\text{Media comprising chlorine ions } (Cl^-)\text{: } 2Cl^- \rightarrow Cl_2 + 2e^- \quad [4]$$

To prevent anodic materials flowback from the well and at the same time to seal the punched holes, a batch of epoxy resin or any other material able to become rigid, may be pumped at the end of treatment (see FIG. 7). In case of sacrificial systems, the use of cement slurry is not recommended since the materials employed as sacrificial anode have amphoteric character showing active corrosion in presence of alkaline media like cement slurries.

The invention will be disclosed in further detail by means of the following non-limiting examples.

EXAMPLES

Example 1. Slurry for Sacrificial Anode Cathodic Protection System

Figure 8:
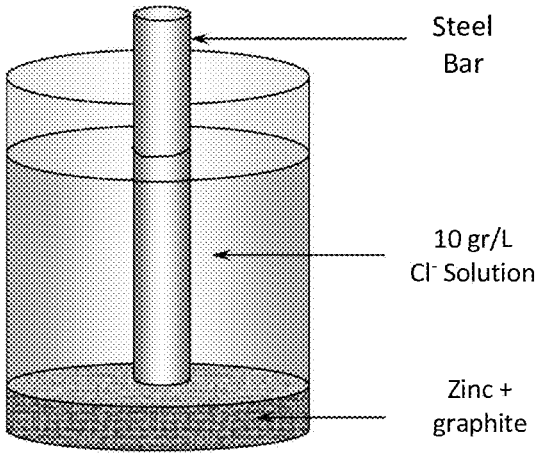
FIG. 8 shows a schematic view of cells used to test and assess a cathodic protection system.

Carbon steel bars (AISI 1040) were immersed in a NaCl solution having a chloride concentration of 10 g/L, contained within cylindrical cells. Granulated anode metal (Zinc #70) is added to said solution, with and without the addition of graphite as high conductivity filler backfill. FIG. 8 shows a schematic view of a cell employed in the assays.

The electrochemical potential of the steel bars with respect to a saturated Calomel electrode (SCE) was monitored during 350 days, so as to determine whether the anode material polarizes steel and protects it from corrosion. Cells with steel bars, without the addition of anode material, were used as blank. The assay conditions were as follows:

Volume of NaCl solution: 200 mL

Exposed steel area: 3 $cm^2$

Cells:

a) Blank: solution without the addition of Zn, b) Solution with the addition of 200 g of Zn, and c) Solution with the addition of 100 g of Zn and 100 g of graphite.

Figure 9:
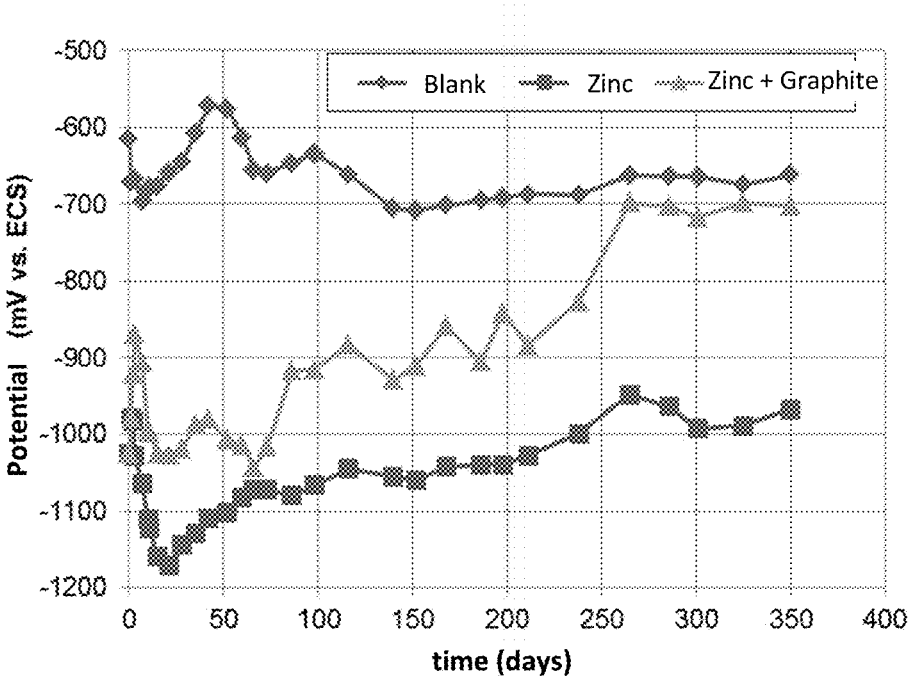
FIG. 9 illustrates steel electrochemical potential evolution over time, under cathodic protection assay conditions.

Each assay was performed in quadruplicate, potentiodinamically, at a scan rate of 0.2 mV/s. FIG. 9 shows the results of electrochemical potential measured with respect to a saturated Calomel electrode (SCE) during 350 days of exposure.

As can be appreciated in FIG. 9, the corrosion potential of steel without protection gets stable at −0.68 $V_{ECS}$ since day 150 after exposure to the saline solution.

In case of protection with Zn (steel bars in contact with granulated Zn), the electrochemical potential of steel starts from −1.1 $V_{ECS}$ and shows a reduction of about 100 mV at the end of the assay. When comparing this condition with the Blank solution, it can be appreciated that the anode material cathodically polarizes steel in more than 300 mV.

Finally, in case of protection with Zn+graphite, the electrochemical potential appears less stable, varying initially between −0.9±0.05 $V_{ECS}$, and after an exposure time of 200 days it decreases until stabilizing in about −0.7 $V_{ECS}$.

From the information provided in FIG. 9 it can be concluded that steel immersed in a 10 g/L [$Cl^-$] solution has active corrosion potentials. At the end of the assay, the steel bars without protection showed generalized corrosion, with abundant brown/orange corrosion products. By incorporating Zn (with and without high conductivity backfill) steel is cathodically polarized between 300 and 400 mV. This can be verified by inspecting the steel bars once the assay is finished, when no corrosion signs are evident after an exposure time of 350 days. The addition of backfill (as crystalline graphite or activated coke) provides protection of steel during the first part of the assay (until about day 200), being cathodically polarized with respect to the Blank solution. Polarization decreases, with similar results to the Blank solution after 250 days.

The obtained results confirm that the addition of granulated Zn to the saline solution causes polarization and corresponding steel cathodic protection. In the case of employing Zn without high conductivity backfill (graphite), protection lasts longer than 350 days, while in the case of employing Zn with high conductivity backfill (Zn+graphite), protection lasts for about 240 days, but using only 100 g of Zn (50% less) in this case.

Figure 10:
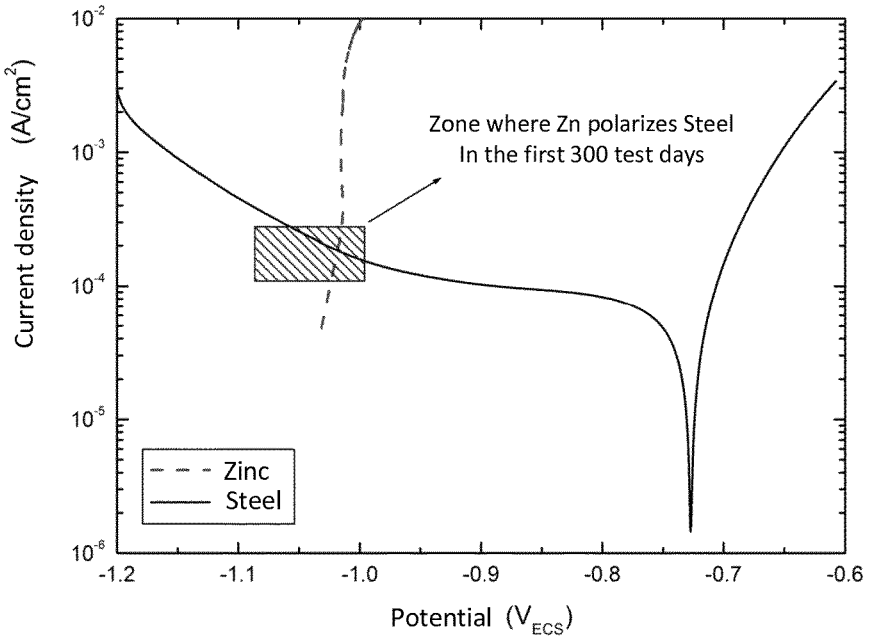
FIG. 10 shows polarization curves for SAE 1040 steel and zinc within a solution containing $[Cl^-]=10$ g/L. It also shows a detail of the zone corresponding to the corrosion potentials shown in FIG. 9.

In order to determine the current drained by the anode (Zn) and thereby to predict the protection system durability, polarization curves were obtained for both metals (SAE 1040 steel and zinc) in the same saline solution (10 g/L $Cl^-$) used in the assays above. Similarly to the steel case, for the zinc assay bar electrodes were employed instead of granulated zinc, due to the impossibility of precisely determining the exposed area in a granulated material. The assays in this case were galvanostatic, and applying stepped current increments. FIG. 7 shows the anodic curves for zinc as well as the anodic and cathodic curves for steel. FIG. 10 shows the zone corresponding to protection potentials as measured for zinc (without high conductivity backfill) as reported in FIG. 9.

The corrosion potential of steel identified in the polarization curve (Ecurr=−0.73 $V_{ECS}$) observed in FIG. 10 corresponds to the potential values measured in Blank condition (steel bar without protection). The cathodic curve of steel shows a behavior corresponding to electrochemical processes controlled by mass transference, where the limit current of oxygen diffusion is identified, given by the reaction:

$$O_2+4H^++4e^-\rightarrow 2H_2O \quad [5]$$

As from about −1.0 $V_{ECS}$ a lineal increase of current density logarithm vs. applied potential is appreciated, due to hydrogen evolution reaction according to equation:

$$2H^++2e^-\rightarrow H_2 \quad [6]$$

Meanwhile, the anodic behavior of zinc (broken-line curve) shows a continuous exponential increment in the current density with overpotential, corresponding to an active dissolution process (charge transference) according to Equation 1, the Zn version of which is as follows:

$$Zn\rightarrow Zn^{2+}+2e^- \quad [7]$$

Corrosion potential of Zn is of about 1.050 $V_{ECS}$ and the Tafel's slope is of about 60 mV/dec.

When overlapping both polarization curves, it can be appreciated that for a system where anode and cathode areas are similar, the mixed potential of steel-zinc cupla is of about −1.0 $V_{ECS}$. This potential is in accordance with the results illustrated in FIG. 9 and shows that zinc cathodically protects steel.

According to FIG. 10, the current density drained by zinc to protect steel (intersection of anodic curve of zinc with cathodic curve of steel) is of about 0.2 mA/cm$^2$ (or 200 mA/m$^2$). This value is consistent with data reported in literature (L. Lazzari and P. Pedeferri, "Cathodic Protection", Polipress (2006) Milano, Italy, page 8.) where, in the case of steel exposed to sea water containing a chloride solution less concentrated that the one used in the assays of the present specification, it should be in the range of 50-550 mA/cm$^2$.

From the information obtained in this study, the cathodic protection of casings of hydrocarbon producing wells or water injecting/producing wells is analyzed. The mass of zinc required for protecting 100 m of 5½" diameter casing during 10 years will be:

$$\text{Zn Mass (Kg)} = \frac{i(A/m^2)\times A(m^2)\times t(\text{years})\times 8760}{\text{Use } F.\times \text{Anode Cap. } (A \text{ hour/kg})} \quad [8]$$

where in this case the protection current density i=0.2 A/m$^2$, the casing area=3.14×5.5"×0.0254 m×100 m=43.8 m$^2$, the use factor=0.8 and the Zn draining capacity=780 A hour/kg. By replacing said data in Eq. 8:

Required Zn anode mass=1235 Kg.

Said mass of granulated anode material may be pumped in a conventional operation of the batch-frac type.

This Example shows that it is possible to provide sacrificial anode cathodic protection to a metallic underground structure during a long period creating a sacrificial anode with granulated metal to be pumped into a formation in liquid form. In case of hydrocarbon producing wells or water injecting/producing wells, the protection is created by injecting a slurry containing the granulated anode metal through punched holes made in the casing zone to be protected.

Example 2. Slurry for Impressed Current Cathodic Protection Systems

As indicated above, the composition of a slurry of the invention used as disperser anode in impressed current cathodic protection systems contains a granulated anode material with high corrosion resistance and high electrical conductivity. Said material could be a metallic material, preferably iron-silicon alloys, stainless steel, titanium, platinum, etc. and/or a non-metallic material like graphite, coke or activated carbon, a mixture of metallic oxides (MMO), etc.

Similarly to the sacrificial slurry, solid materials are carried into the underground formation by means of a fluid with adequate viscosity. In a typical configuration, the disperser anode may have a design similar to a deep disperser well for impressed current cathodic protection, where the slurry of the invention replaces the conventional disperser anodes (see FIG. 2).

When designing the impressed current system of the invention, cathodic protection conventional criteria should be taken into consideration. Besides that, certain aspects should be contemplated in order to establish the slurry composition, anode geometry as well as the methodology for placing the disperser slurry underground.

Disperser slurry composition. The proportion of granulated metallic or non-metallic, solid materials contained in the slurry may vary depending upon their electrical properties. Once pumped into the formation, the carrier fluid comprised in the slurry drains into the formation creating a compact pack of solid materials. The proportion of granulated metal with respect to the high conductivity backfill may vary between 10 to 100% v/v. The higher the load of granulated solid material in the pack, more efficient the disperser anode will be. Taking the composition of hydraulic fracture fluids as reference, where (natural or synthetic) proppants are pumped and carried by a gel of determined viscosity, the solid material load in the slurry may vary typically between 0.1 and 1 Kg/L. Viscosifiers may comprise natural (guar gum, cellulose and their derivates) or synthetic (PHPA, PVA, etc.) polymers Disperser anode geometry. An adequate disperser anode geometry is determined by controlling the slurry pumping parameters. For obtaining an extended anode geometry like that illustrated in FIG. 2, it is necessary to fracture the formation and to inject the slurry ensuring that the solid material (metallic or non-metallic) is transported into the fracture. Length and height of the produced fracture will depend on the formation mechanical properties, stresses (lithostatic, tectonic and pore pressure) acting on the formation, pumping regime or rate (flowrate and pressure) and slurry rheological properties (M. Ecconomides and K. Nolte, "Reservoir Stimulation", 3rd Edition, J. Wiley Edt., Schlumberger, 2000, Chap. 5 and 6). Therefore, for establishing the disperser anode geometric design, it can be applied knowledge and similar criteria employed in hydraulic fracture of hydrocarbon producing formations.

Figure 11:
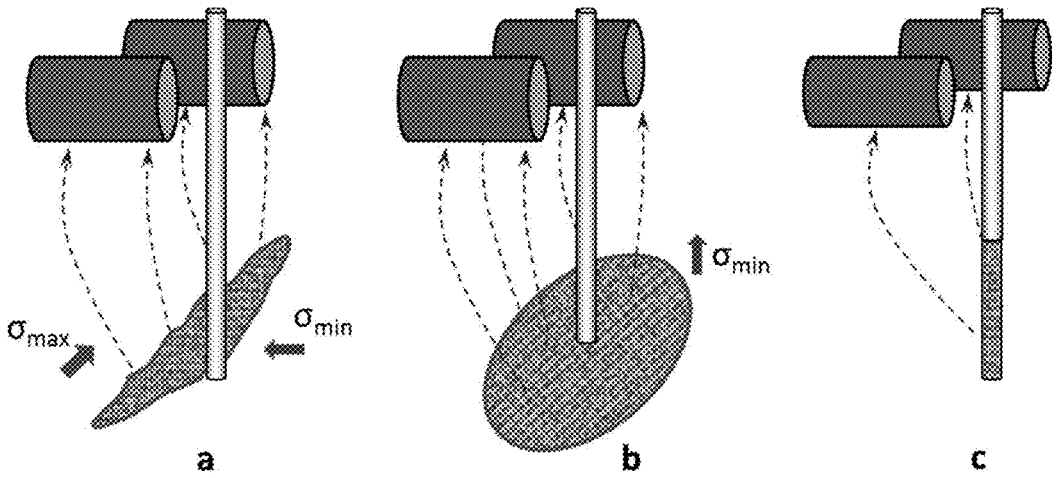
FIG. 11, *a-c*, shows disperser anode geometries according to acting stresses and operation mode: vertical fracture, horizontal fracture and no fracture, respectively.

In those cases where the minimum stress ($\sigma_{min}$) acting on the formation is horizontally oriented, the fracture geometry will show two wings perpendicularly aligned with $\sigma_{min}$, as can be appreciated in FIG. 11-*a*. On the contrary, if the minimum stress ($\sigma_{min}$) corresponds to formation lithostatic stress, the fracture will propagate horizontally, forming a disc around the well. This disperser anode geometry is highly convenient for obtaining a uniform current distribution on a wide zone, as can be appreciated in FIG. 11-*b*. Finally, in case it is not necessary to produce a wide current distribution, the disperser anode design may be limited to the original well diameter, as can be appreciated in FIG. 11-*c*. Although this disperser anode geometry is similar to those employed in conventional installations of impressed current cathodic protection, the method of the invention does not employ discrete anodes (corrosion resistant conductive bars or tubular materials) since the anodes of the present invention consist of a slurry comprising high conductivity granulated material (metallic and/or non-metallic).

Cathodic protection design. For designing an impressed current cathodic protection system employing the disperser slurry anode of the invention it is necessary to know the anode geometry. Length and height of the fracture produced during slurry pumping may be determined by employing general knowledge about hydraulic fracturing of hydrocarbon producing formations (M. Ecconomides and K. Nolte, "Reservoir Stimulation", 3rd Edition, J. Wiley Edt., Schlumberger, 2000, Chap. 5 and 6.).

Knowing the fracture disposition: vertical or horizontal (see FIGS. 11-*a* and 11-*b*) and the fracture dimensions (effective height and length), anode electric resistance $R_A$ may be determined by means of any known equations (see e.g. L.L. Sheir and L. A. Jerman, "Corrosion", Vol. 2 (Corrosion Control), Butterworth Heinemann (1994), Great Britain, Chap. 10; or L. Lazzari and P. Pedeferri, "Cathodic Protection", Polipress (2006) Milano, Italy, page 8). Equation 9 is one of the most employed equations for anode geometries of the plate type (both vertical and horizontal):

$$R_A(\Omega) = \frac{0.315 \cdot \rho(\Omega\text{cm})}{\sqrt{A(\text{cm}^2)}} \quad (9)$$

where ρ is the medium electrical resistivity and A is the anode plate area.

By way of example, considering a disperser anode with a configuration similar to that illustrated in FIG. 11-*a*, having a fracture effective length of 20 m and height of 10 m, and assuming an earth resistivity of 10000 Ωcm, $R_A$ will be:

$$R_A(a)=0.016\Omega$$

In the case of considering an anode configuration like that illustrated in FIG. 11-*b* having the same effective length (20 m) and earth resistivity than the previous case, $R_A$ will be:

$$R_A(b)=0.00025\Omega$$

Finally, if the anode configuration is that corresponding to FIG. 11-*c*, the anode resistance $R_A$ is determined by means of the following equation (see e.g. L. L. Sheir and L. A. Jerman, "Corrosion", Vol. 2 (Corrosion Control), Butterworth Heinemann (1994), Great Britain, Chap. 10; or L. Lazzari and P. Pedeferri, "Cathodic Protection", Polipress (2006) Milano, Italy, page 8):

$$R_A(\Omega) = \frac{\rho(\Omega\text{cm})}{2\pi \cdot L(\text{cm})}\left(\ln\frac{4L(\text{cm})}{d(\text{cm})} - 1\right) \quad (10)$$

Also by way of example, considering the anode has a diameter (d) of 25 cm (10"), and an active zone of 20 m and that the earth resistivity is the same than the previous cases, $R_A$ is:

$$R_A(c)=1.198\Omega$$

Said results show the great incidence of the disperser anode geometry on the cathodic protection system efficiency. For a determined electric power source, the current draining capacity decreases as the $R_A$ value increases. The disperser anode embodiment of the present invention provides $R_A$ values that are between 2 and 3 orders of magnitude lower than those of conventional disperser anode embodiments and therefore, the efficiency of the cathodic protection systems with liquid disperser anode of the invention are between 2 and 3 orders of magnitude with respect to conventional installations.

We claim:

1. A method for providing cathodic protection to an underground metallic structure consisting of injecting and pumping into an underground formation containing said metallic structure an anode slurry composition comprising a solid material comprising a granulated electrical conducting material as an anode in a carrier fluid.

2. The method of claim 1, where the metallic structure is part of a hydrocarbon producing well or a water injecting/producing well.

3. The method of claim 2 where the metallic structure is a casing.

4. The method of claim 3 where the injection is performed through a plurality of punched holes made in the casing.

5. The method of claim 1, the injection and pumping are performed at a hydraulic fracture regime or rate so as to ensure packing and electric contact between the solid material contained in the slurry and the structure to be protected.

6. The method of claim 5, where the injection and pumping are performed at a pressure higher than the fracture gradient of the underground formation containing the metallic structure.

* * * * *